US009732557B2

(12) United States Patent
Landers

(10) Patent No.: US 9,732,557 B2
(45) Date of Patent: Aug. 15, 2017

(54) REMOVABLE LADDER WHEELS

(71) Applicant: James Landers, Oconomowoc, WI (US)

(72) Inventor: James Landers, Oconomowoc, WI (US)

( * ) Notice: Subject to any disclaimer, the term of this patent is extended or adjusted under 35 U.S.C. 154(b) by 0 days.

(21) Appl. No.: 14/515,427

(22) Filed: Oct. 15, 2014

(65) Prior Publication Data

US 2015/0204139 A1 Jul. 23, 2015

Related U.S. Application Data

(60) Provisional application No. 61/890,960, filed on Oct. 15, 2013.

(51) Int. Cl.
*E06C 1/397* (2006.01)

(52) U.S. Cl.
CPC ..... *E06C 1/397* (2013.01)

(58) Field of Classification Search
CPC ..... E06C 1/397; B62B 5/0083; B62B 5/0086; A45C 13/385; B62D 51/04
See application file for complete search history.

(56) References Cited

U.S. PATENT DOCUMENTS 1,017,799 A * 2/1912 Read ..... B60B 33/0002 16/30
1,530,116 A * 3/1925 Hawkins ..... A47D 13/02 16/235
2,521,114 A * 9/1950 Campbell ..... E06C 1/18 182/116
3,260,533 A * 7/1966 Ryder ..... B28C 5/0856 16/32
3,282,375 A * 11/1966 Ray ..... A01M 31/02 182/116
3,580,601 A * 5/1971 Miles ..... B62B 3/009 248/176.1
4,045,040 A * 8/1977 Fails ..... A01M 31/006 182/118
4,083,606 A * 4/1978 Scruggs ..... B60B 7/14 301/37.21
4,497,502 A * 2/1985 Forbes ..... B62D 9/02 280/240
4,559,962 A * 12/1985 Marchiano ..... A61H 3/068 135/85
5,282,520 A * 2/1994 Walker ..... A01M 31/006 182/116
5,328,192 A * 7/1994 Thompson ..... B62B 1/208 280/43.1

(Continued)

*Primary Examiner* — Katherine Mitchell
*Assistant Examiner* — Shiref Mekhaeil
(74) *Attorney, Agent, or Firm* — Global Intellectual Property Agency, LLC; Daniel Boudwin

(57) ABSTRACT

A wheel and bracket device that is removably attachable to a ladder. The present invention allows users to more conveniently transport a ladder, ladder tree stand, or other such device, along with objects that may be supported thereon. The present invention is a bracket that is adapted to enclose a rail and a rung of a ladder and be securely affixed to the ladder via a locking mechanism, such as a locking pin. A wheel is rotatably attached to the bracket, thereby allowing users to push or pull the ladder across terrain, rather than being forced to carry the ladder.

6 Claims, 2 Drawing Sheets

(56) References Cited

U.S. PATENT DOCUMENTS 5,579,972 A * 12/1996 Despain ..... B60R 9/10 224/506
5,590,738 A * 1/1997 Hunt ..... A01M 31/02 182/116
5,800,022 A * 9/1998 Del Rosario ..... A63C 17/06 280/11.221
5,882,023 A * 3/1999 Swager ..... B62B 5/0083 280/47.131
6,120,106 A * 9/2000 Liao ..... B60B 37/10 301/111.06
6,283,496 B1 * 9/2001 Dickmann ..... B62B 1/208 280/40
6,409,283 B1 * 6/2002 Hsieh ..... B60B 37/10 190/18 A
7,114,731 B2 * 10/2006 Malrick ..... B62B 1/10 280/47.2
7,172,207 B2 * 2/2007 Henry ..... B60D 1/00 280/40
7,328,907 B1 * 2/2008 Bileth ..... A47F 5/137 280/79.11
7,766,365 B2 * 8/2010 Darling, III ..... A61G 1/013 280/47.18
7,775,307 B2 * 8/2010 Cheng ..... A61G 5/043 180/22
7,849,964 B2 * 12/2010 Amacker ..... A01M 31/006 182/136
8,162,329 B1 * 4/2012 Openshaw ..... B62B 1/268 280/47.131
8,424,639 B1 * 4/2013 Davis ..... E06C 1/397 182/115
8,505,932 B1 * 8/2013 Piccirillo ..... B62B 5/0003 280/30
8,505,959 B2 * 8/2013 Darling, III ..... A61G 1/013 280/640
8,960,693 B1 * 2/2015 Cotner ..... B62B 1/06 280/47.131
8,967,592 B2 * 3/2015 Cozza ..... B62B 1/26 254/2 R
9,056,623 B1 * 6/2015 Woller ..... B62B 1/16
9,221,301 B1 * 12/2015 Pastore ..... B60B 33/02
2002/0041084 A1 * 4/2002 Darling, III ..... B62B 1/002 280/652
2003/0127815 A1 * 7/2003 Hall ..... B60B 33/0002 280/79.3
2004/0150195 A1 * 8/2004 Robberson ..... B62B 1/12 280/652
2005/0015928 A1 * 1/2005 Arsenault ..... B60B 33/0002 16/300
2006/0038369 A1 * 2/2006 Abraham ..... B62B 5/0083 280/79.7
2007/0169994 A1 * 7/2007 Oftedahl ..... A01M 31/006 182/116
2007/0205027 A1 * 9/2007 Snellenberger ..... B62D 51/04 180/19.1
2008/0042023 A1 * 2/2008 Williams ..... A47B 91/00 248/188.1
2008/0111348 A1 * 5/2008 Lawson ..... B60D 1/143 280/511
2010/0029416 A1 * 2/2010 Lindstrom ..... A63B 63/00 473/477
2011/0275461 A1 * 11/2011 Pastore ..... A63B 63/004 473/478
2013/0287531 A1 * 10/2013 Connors ..... B66B 9/193 414/598
2015/0101913 A1 * 4/2015 Benke ..... B62B 3/008 200/50.23

* cited by examiner

REMOVABLE LADDER WHEELS

CROSS REFERENCE TO RELATED APPLICATION

This application claims the benefit of U.S. Provisional Application No. 61/890,960 filed on Oct. 15, 2013. The above identified patent application is herein incorporated by reference in its entirety to provide continuity of disclosure.

BACKGROUND OF THE INVENTION

Field of the Invention

The present invention relates to a conversion kit for ladders that is adapted to make the ladder itself easier to transport or provide users with a means to transport objects using the ladder as a support surface. More specifically, the present invention comprises a wheel that is adapted to be removably attached to a ladder, around a rail and a rung, via a bracket and locking mechanism.

Conventional ladders, tree stands having an attached ladder portion, and other such devices can be extremely cumbersome to transport due to their length, weight, hinged or otherwise movable components that can shift during transport, and other such characteristics of their design. Individuals cannot simply push or pull these devices and are instead forced to carefully carry these unwieldy objects, holding them in a balance position while ensuring that the opposing ends to not make contact with any other objects in the surrounding area.

Additionally, when individuals make a kill while hunting, the process of transporting a tree stand and the kill back to their vehicle can be very time-consuming. This process is very time-consuming because hunters must separately carry the ladder tree stand and the kill back to their vehicles because of the weight and general cumbersome nature of the ladder tree stand and most kills prevents them from being carried simultaneously. Furthermore, the amount of effort and time expended for the multiple trips is exacerbated by the distance from the hunter's chosen hunting location and the hunter's vehicle and the type of terrain therebetween. Taking multiple trips between the hunter's vehicle and his or her hunting location, while struggling with heavy, unwieldy objects each trip, can be an exhausting, frustrating process.

DESCRIPTION OF THE PRIOR ART

Devices have been disclosed in the prior art that relate to game hauling devices, wheeled ladders, and wheeled tree stand devices. These include devices that have been patented and published in patent application publications. These devices generally relate to dollies that are adapted to carry game or ladder tree stands having integral wheels. The following is a list of devices deemed most relevant to the present disclosure, which are herein described for the purposes of highlighting and differentiating the unique aspects of the present invention, and further highlighting the drawbacks existing in the prior art.

Combination hunting tree stands and game hauling devices are known in the prior art. These devices generally comprise ladder tree stands having integral wheels and an integral dolly portion, thereby providing hunters with a means to simultaneously transport their ladder tree stand and their kill. These devices have several drawbacks, however. First, because the wheels are integrally affixed to the ladder tree stand, hunters are unable to alter the positioning of the wheels. Conversely, with the present invention, hunters are able to adjust the position of the wheels to change the location of the fulcrum of the device, thereby allowing users to change the configuration of the device to account for loads of different weights and the most comfortable carrying position. Second, because these devices are single units, hunters are restricted solely to these devices if they wish to utilize a transportable tree stand that is also adapted to carry game.

Conversely, the present invention is a conversion kit that is adapted to work with all types of ladder tree stands. The present invention allows individuals to use any type of ladder tree stand that they wish because the wheels can be freely attached, removed, and interchanged between different ladder tree stands as desired by the user. Therefore, if a hunter has a favorite ladder tree stand that he or she strongly would prefer to use, then he or she can continue to use it without the need to purchase an entirely new ladder tree stand. Furthermore, the present invention can be utilized with conventional ladders and other similar devices and is not solely restricted to work solely with ladder tree stands. The present invention therefore offers substantial flexibility and customizability overly devices currently known in the prior art.

Specialized dollies or hand trucks adapted to carry game are also known in the prior art. However, these devices nonetheless do not eliminate the need for a separate ladder and thus have a minimal impact on the amount of time and effort expended by hunters when leaving their hunting location and returning to their vehicle with their equipment and game. The present invention is specifically adapted to provide individuals with a means to reduce the number of back and forth trips that they must take between their hunting location and their vehicle after they have concluded their hunting endeavor.

The present invention substantially diverges in design elements from the prior art and consequently it is clear that there is a need in the art for an improvement to existing ladder tree stand game hauling devices. In this regard the instant invention substantially fulfills these needs.

SUMMARY OF THE INVENTION

In view of the foregoing disadvantages inherent in the known types of game hauling devices, transportable ladder stands, and ladder stands adapted to additionally haul game now present in the prior art, the present invention provides a new ladder or ladder stand conversion kit comprising wheels that are removably affixable to a ladder wherein the same can be utilized for providing convenience for the user when carrying a ladder tree stand and game.

It is therefore an object of the present invention to provide a removable ladder wheel device that has all of the advantages of the prior art and none of the disadvantages.

It is another object of the present invention to provide a removable ladder wheel device that provides individuals with a means to simultaneously transport both a ladder or ladder tree stand and one or more objects supported thereon.

Another object of the present invention is to provide a removable ladder wheel device that is adjustably affixable to the ladder or ladder tree stand, allowing for the fulcrum of the resulting wheeled ladder to be altered as desired by the user.

Yet another object of the present invention is to provide a removable ladder wheel device that is adapted to be interchangeably utilized with a variety of different ladders or ladder tree stands.

Yet another object of the present invention is to provide a removable ladder wheel device that can be quickly and easily attached and detached from the ladder or ladder tree stand.

Still yet another object of the present invention is to provide a removable ladder wheel device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
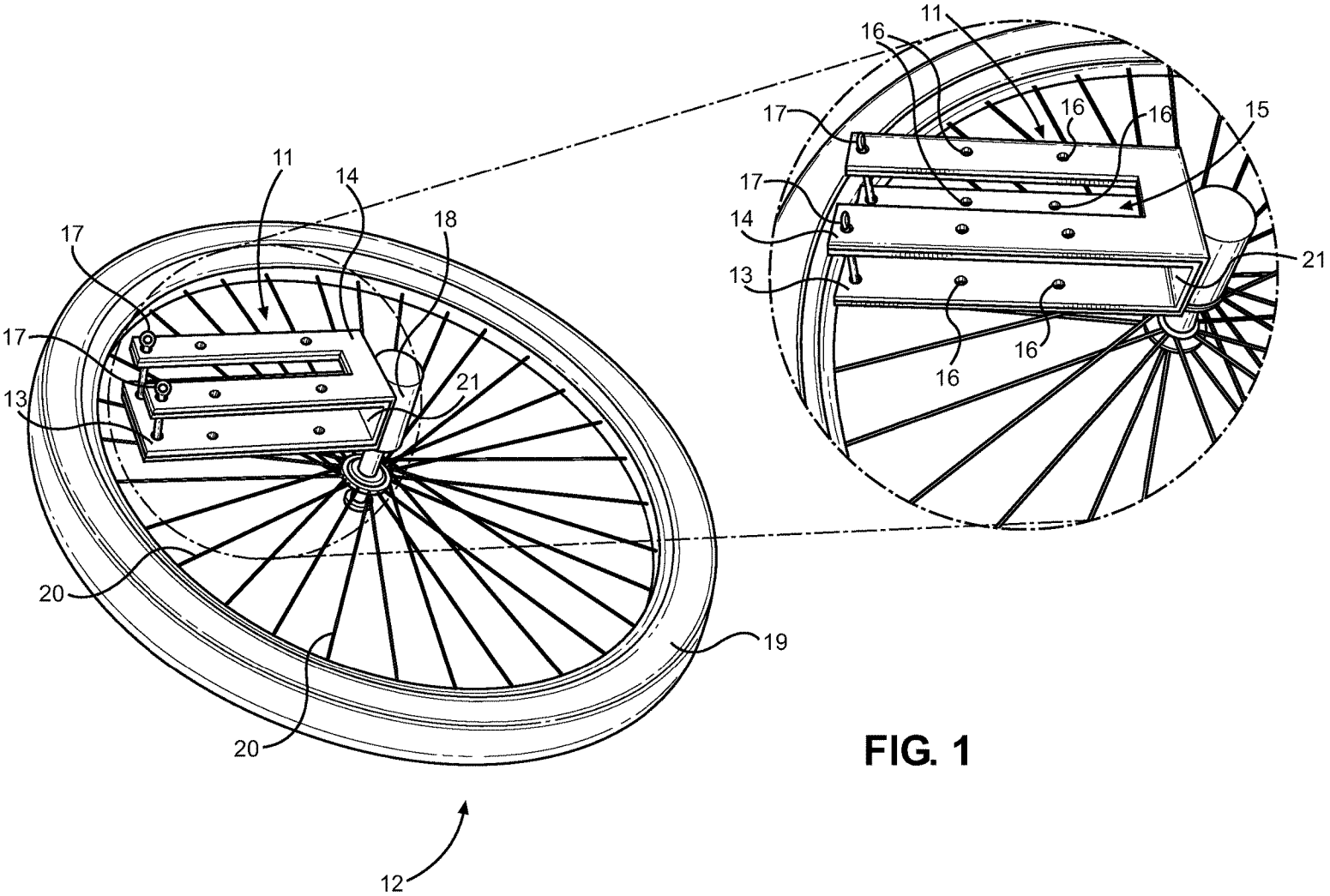
FIG. 1 shows a perspective view of the present invention.

Reference is made herein to the attached drawings. Like reference numerals are used throughout the drawings to depict like or similar elements of the ladder conversion kit for hauling objects. For the purposes of presenting a brief and clear description of the present invention, the preferred embodiment will be discussed as used with ladder tree stands for hauling game. The figures are intended for representative purposes only and should not be considered to be limiting in any respect.

Figure 2:
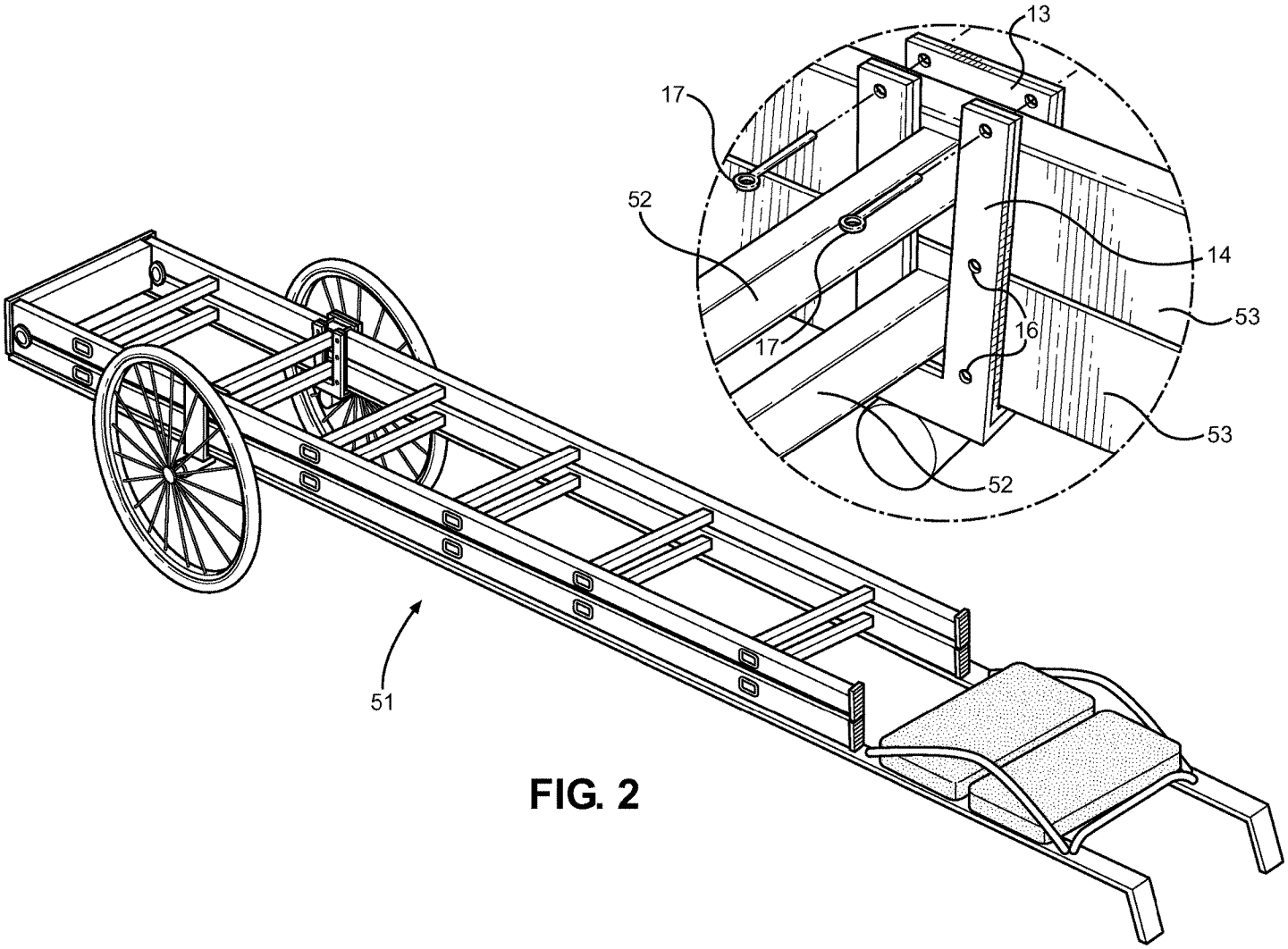
FIG. 2 shows a perspective view of the present invention being secured to a ladder tree stand.

Referring now to FIGS. 1 and 2, there are shown a perspective view of the present invention and a perspective view of the present invention being secured to a ladder tree stand. The present invention is a bracket 11 and wheel 12 that is removably attachable to a ladder tree stand 51 or other similar devices such as ladders or devices that have ladder or ladder-like portions in order to make it more convenient to transport the ladder tree stand 51 and additionally convert the ladder tree stand 51 into a carrying device for supporting objects thereon. The present invention comprises a bracket 11 having a first arm 13 and a second arm 14 connected by a cross member 21 positioned perpendicularly therebetween. The first and second arms 13, 14 are in a spaced relationship and are adapted to accept a ladder rail 53 therethrough. In the depicted embodiment of the present invention, the first and second arms 13, 14 are disposed in a parallel relationship, creating a substantially rectangular, U-shaped bracket 11 adapted to accept a portion of a rectangular ladder rail 53. However, no claim is made as to a specific orientation or positioning of the first and second arms 13, 14 and alternative orientations of the first and second arms 13, 14 may be provided in order to accommodate ladder rails 53 of various shapes and configurations.

The first arm 13 further comprises a channel 15 disposed thereon that is adapted to accept a ladder rung 52 therein. In the depicted embodiment of the present invention, the channel 15 is rectangular in shape; however, no claim is made as to a specific shape for the channel 15 as the channel 15 may be adapted to accept ladder rungs 52 of various cross sectional shapes therein. The bracket 11 further comprises a plurality of apertures 16 disposed on the first and second arms 13, 14. Each aperture 16 disposed on the first arm 13 is aligned with a corresponding aperture 16 disposed on the second arm 14, thereby creating at least one set of aligned pairs of apertures 16 through which a locking pin 17 may be inserted. The locking pins 17 extend between the opposing first and second arms 13, 14, creating a physical barrier preventing the bracket 11 from disengaging from the ladder rung and rail 52, 53 to which it is attached, thereby ensuring that the present invention is securely held in place on the ladder tree stand 51. The locking pins 17 comprises any type of locking pin known in the prior art, such as detent ring pins, clevis fasteners, and positive lock pins, or any other locking mechanism known in the prior art that is adapted to removably secure the bracket 11 to a ladder rail 53.

An alternative embodiment of the present invention comprises a plurality of sets of aligned apertures 16 disposed at positions corresponding to various depths of a ladder rail 53. This allows users to adjust the positioning of the locking pin 17 to accommodate ladder rails 53 of various sizes, ensuring that the present bracket 11 is snugly held against the ladder tree stand 51 regardless of the design of the ladder portion. These aligned sets of apertures 16 may be arranged in parallel sub-sets, as depicted, so that multiple locking pins 17 can be used to secure the present invention in place. Alternatively, the aligned sets of apertures 16 may be arranged in a single set so that a single locking pin 17 may be used to hold the present invention in place. In the depicted embodiment of the present invention, the bracket 11 comprises six aligned sets of apertures 16 arranged in two parallel sub-sets extending along opposite sides of the first and second arms 13, 14; however, no claim is made as to a specific number or arrangement of aligned sets of apertures 16.

The offset between the first and second arms 13, 14 defines a space adapted to enclose a ladder rail 53 therein and the channel 15 disposed on the first arm 13 defines a space adapted to enclose a ladder rung 52 therein. The lateral movement of the present invention is restricted in the side-to-side direction, relative to the longitudinal axis of the ladder 51, by the first and second arms 13, 14 and in the up-and-down direction by the locking pins 17 and the cross member 21 disposed substantially parallel thereto. The longitudinal movement of the present invention is restricted by the channel 15, which encloses a ladder rung 52. As the present invention is locked to both a ladder rail 53 and a ladder rung 52, it is securely held in place to the ladder portion of the ladder tree stand 51 and can cannot slip or fall therefrom in either longitudinal or lateral directions.

The present invention further comprises a wheel 12 extending from said bracket 11. The wheel 12 is rotatably connected to the bracket 11 via any means known in the prior art. The wheel 12 is positioned so that when the bracket 11 is secured to the ladder rail 53 and rung 52, the wheel 12 may freely rotate without obstruction from the ladder portion of the ladder tree stand 51. In the depicted embodiment of the present invention, the wheel 12 extends from the cross member 21 portion of the bracket 11 and is disposed adjacently to the exterior surface of the ladder rails 53 when the present invention is attached to a ladder tree stand 51. In an alternative embodiment of the present invention, the wheel 12 may be attached to the bracket 11 such that the wheel is disposed beneath the ladder tree stand 51 when the present invention is affixed thereto, or in any other orientation that allows for the free and unobstructed rotation of the wheel 12.

The wheel 12 is a conventional wheel as is commonly known in the prior art. In the depicted embodiment of the present invention, the wheel 12 comprises a tire 19 and a plurality of spokes 20 rotatably connected to a hub 18. The hub 18 is attached to the cross member 21 of the bracket 11. It is contemplated that the hub 18 may be attached to the cross member 21 via a fastener or the hub 18 and the cross member 21 may be welded together. In one embodiment of the present invention, the tire 19 is composed of puncture-proof material, such as solid polyurethane. This is an advantageous design because when transporting a ladder tree stand 51 from a hunting location in the wilderness utilizing the present invention, the user may be forced to transport the ladder tree stand 51 over rough terrain.

When attached to a ladder tree stand 51, the present invention provides a removable wheel 12 or set of wheels when used in combination, thereby allowing users to push or pull a ladder or ladder tree stand 51, rather than being forced to carry the ladder or ladder tree stand. Furthermore, when the present invention is affixed to a ladder or ladder tree stand 51, the ladder or ladder tree stand 51 can then be used as a second class lever with a support surface for carrying various objects thereon, allowing individuals to efficiently transport both the ladder tree stand 51 and other objects simultaneously. As the bracket 11 may be freely affixed around any of the ladder rungs 52, the user can adjust the position of the present invention on the ladder tree stand 51 depending upon the weight and size of the load to be transported, the most comfortable position for the user, and the terrain over which the user will be traversing.

The present invention is utilized by sliding a ladder rung 52 of the user's choosing into the channel 15, which additionally causes the first and second arms 13, 14 to slide over an adjacent portion of the ladder rail 53. The user then places the locking pins 17 through the aligned sets of apertures 16 corresponding to the depth of the ladder rail 53, thereby ensuring that the bracket 11 is securely held thereagainst. Once the present invention is secured in place, users may then load other objects onto the upper surface of the ladder tree stand 51 and then simultaneously transport both the ladder tree stand 51 itself and the objects supported thereon. The present invention is usable with conventional ladders, ladder tree stands, and other such devices having ladder or ladder-like components. The present invention is ideally suited for transporting both a ladder tree stand and the user's killed game after the user has been hunting.

Without the present invention, these hunters generally must take multiple separate trips to carry their equipment, ladder tree stand, and game from their hunting location to their vehicle because it would be impossible to carry all of those items due to their bulk. However, the present invention provides a convenient, efficient means for simultaneously transporting all of these items when the hunter is alone or otherwise lacks assistance to carry his or her goods. The present invention is preferably utilized in at least pairs, wherein each of the pair is secured to an opposite ladder rail 53 so that the ladder tree stand 51 and load carried thereon is balanced between each device.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device, comprising:

a bracket having a first arm and a second arm;

a wheel rotatably affixed to said bracket and mounted laterally offset from one of said arms of said bracket;

a channel disposed in said first arm, said channel adapted to accept a rung of a ladder therein;

wherein each of said first arm and said second arm comprising at least one aperture;

said at least one aperture of said first arm is aligned with said at least one aperture of said second arm;

at least one pin securable through said aligned at least one aperture of said first arm and said at least one aperture of said second arm;

said at least one pin adapted to secure said bracket to said ladder.

2. The device of claim 1, wherein said aligned apertures are disposed at multiple depths.

3. The device of claim 1, wherein said wheel further comprises a tire composed of puncture-proof material.

4. The device of claim 1, wherein said first arm and said second arm are parallel.

5. The device of claim 1, wherein said bracket further comprises a cross member having said first arm and said second arm extending upward therefrom.

6. The device of claim 5, further comprising:

a hub that is centrally located on said wheel;

wherein said hub is attached to said cross member of said bracket.

* * * * *